US010948229B2

(12) United States Patent
Bertolini et al.

(10) Patent No.: US 10,948,229 B2
(45) Date of Patent: Mar. 16, 2021

(54) SHELF-INTEGRATED WATER DISPENSER FOR REFRIGERATOR APPLIANCE

(71) Applicants: BSH Home Appliances Corporation, Irvine, CA (US); BSH Hausgeräte GmbH, Munich (DE)

(72) Inventors: Nilton Bertolini, Knoxville, TN (US); Jorge Carlos Montalvo Sanchez, Knoxville, TN (US); Conner Wainauski, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 178 days.

(21) Appl. No.: 16/273,299

(22) Filed: Feb. 12, 2019

(65) Prior Publication Data

US 2020/0256614 A1 Aug. 13, 2020

(51) Int. Cl.

| | |
|---|---|
| ***F25D 23/04*** | (2006.01) |
| ***F25D 23/02*** | (2006.01) |
| ***F25D 25/02*** | (2006.01) |
| *F25D 23/12* | (2006.01) |

(52) U.S. Cl.

CPC ..... *F25D 23/04* (2013.01); *F25D 23/028* (2013.01); *F25D 25/02* (2013.01); *F25D 23/126* (2013.01); *F25D 2323/121* (2013.01)

(58) Field of Classification Search

CPC .. F25D 2323/121; F25D 23/028; F25D 23/04; F25D 23/067; F25D 23/126; F25D 25/02

See application file for complete search history.

(56) References Cited

U.S. PATENT DOCUMENTS

| | | | |
|---|---|---|---|
| 2,096,481 | A | 10/1937 | Frykgahl |
| 2,118,910 | A | 5/1938 | White |
| 2,282,276 | A | 7/1940 | White |
| 2,477,210 | A | 7/1949 | Skinner |
| 2,788,642 | A | 4/1957 | Burkhead |
| 3,570,266 | A | 3/1971 | Alvarez et al. |
| 5,263,509 | A | 11/1993 | Cherry et al. |
| 6,079,221 | A | 6/2000 | Senner |
| 6,912,870 | B2 | 7/2005 | Gnadinger |
| 7,201,005 | B2 | 4/2007 | Voglewede et al. |
| 7,210,601 | B2 | 5/2007 | Hortin et al. |
| 7,543,453 | B2 | 6/2009 | Boarman et al. |
| 7,591,399 | B2 | 9/2009 | Hortin et al. |

(Continued)

FOREIGN PATENT DOCUMENTS

| | | | |
|---|---|---|---|
| DE | 19631374 | A1 | 2/1998 |
| EP | 1602622 | A1 | 12/2005 |

(Continued)

OTHER PUBLICATIONS

National Search Report EP 20153080 dated Jun. 11, 2020.

*Primary Examiner* — Filip Zec

(74) *Attorney, Agent, or Firm* — Michael E. Tschupp; Andre Pallapies; Brandon G. Braun

(57) ABSTRACT

A refrigerator including a fresh food compartment; at least one shelf disposed in the fresh food compartment, the at least one shelf being supported by at least one shelf support bracket; and a water dispenser integrated with the at least one support bracket and accessible from the fresh food compartment.

20 Claims, 16 Drawing Sheets

(56) References Cited

U.S. PATENT DOCUMENTS

| | | | | |
|---|---|---|---|---|
| 7,658,212 | B2 | 2/2010 | Meuleners et al. | |
| 7,869,901 | B2 | 1/2011 | Johnson et al. | |
| 8,109,301 | B1 | 2/2012 | Denise | |
| 8,117,865 | B2 | 2/2012 | Allard et al. | |
| 8,245,735 | B2 | 8/2012 | Chase et al. | |
| 8,322,384 | B2 | 12/2012 | Ashrafzadeh et al. | |
| 8,453,476 | B2 | 6/2013 | Kendall et al. | |
| 8,499,578 | B2 | 8/2013 | Ferragut, II et al. | |
| 8,714,210 | B2 | 5/2014 | Ashrafzadeh et al. | |
| 8,938,985 | B2 | 1/2015 | Lim et al. | |
| 9,085,453 | B2 * | 7/2015 | McMahan | B67D 1/1238 |
| 9,113,749 | B2 | 8/2015 | Castellani et al. | |
| 9,287,021 | B2 | 3/2016 | Hammond et al. | |
| 9,334,150 | B1 | 5/2016 | Ost et al. | |
| 9,347,701 | B2 | 5/2016 | Kendall et al. | |
| 9,533,867 | B2 | 1/2017 | Hortin | |
| 9,595,373 | B2 | 3/2017 | Hammond et al. | |
| 9,714,110 | B2 * | 7/2017 | Veltrop | B67D 7/78 |
| 9,795,010 | B2 | 10/2017 | Kendall et al. | |
| 10,611,612 | B2 | 4/2020 | Gonzales | |
| 10,684,068 | B1 | 6/2020 | Shi et al. | |
| 10,687,654 | B2 | 6/2020 | Buchholz et al. | |
| 2004/0258567 | A1 | 12/2004 | Alexander | |
| 2005/0178273 | A1 * | 8/2005 | Meuleners | B67D 1/0858 99/279 |
| 2006/0144075 | A1 | 7/2006 | Bowen et al. | |
| 2007/0044497 | A1 | 3/2007 | Roo et al. | |
| 2007/0157638 | A1 | 7/2007 | Wetekamp | |
| 2007/0163282 | A1 | 7/2007 | Bertolaccini | |
| 2008/0163641 | A1 | 7/2008 | Mitchell | |
| 2010/0175417 | A1 * | 7/2010 | Kim | F25D 23/126 62/389 |
| 2011/0174008 | A1 | 7/2011 | Kim | |
| 2012/0103001 | A1 | 5/2012 | Krause et al. | |
| 2012/0180517 | A1 | 7/2012 | Filho et al. | |
| 2013/0146612 | A1 | 6/2013 | Sanchez et al. | |
| 2014/0111118 | A1 | 4/2014 | Kendall et al. | |
| 2014/0283542 | A1 | 9/2014 | Jang | |
| 2014/0299628 | A1 | 10/2014 | Gormley et al. | |
| 2019/0071298 | A1 | 3/2019 | Tomforde et al. | |
| 2019/0178552 | A1 * | 6/2019 | Scalf | F25D 11/02 |
| 2020/0033051 | A1 | 1/2020 | Wantland et al. | |
| 2020/0208904 | A1 | 7/2020 | Choy et al. | |

FOREIGN PATENT DOCUMENTS

| | | | |
|---|---|---|---|
| EP | 1607700 | A2 | 12/2005 |
| EP | 1752723 | A2 | 2/2007 |
| EP | 1795840 | A2 | 6/2007 |
| EP | 1890097 | A1 | 2/2008 |
| EP | 2728282 | A1 | 5/2014 |
| EP | 2295903 | B1 | 10/2018 |
| EP | 2972025 | B1 | 5/2020 |
| WO | 2005111955 | A1 | 11/2005 |
| WO | 2007027072 | A1 | 3/2007 |
| WO | 2008017419 | A2 | 2/2008 |
| WO | 2015024781 | A1 | 2/2015 |

* cited by examiner

SHELF-INTEGRATED WATER DISPENSER FOR REFRIGERATOR APPLIANCE

FIELD OF THE INVENTION

The present disclosure relates generally to a refrigerator appliance and to a shelf-integrated water dispenser for the refrigerator appliance. More particularly, the present disclosure relates to a water dispenser that is integrated with a shelf support bracket for supporting a shelf in the fresh food compartment of a refrigerator appliance.

BACKGROUND OF THE INVENTION

In general, water dispensers can be of an external type having an external dispenser cavity located in a cutout formed in a door of the freezer compartment or fresh food compartment, or of an internal type and located within the fresh food compartment of a refrigerator appliance.

There are known internal type water dispensers that are disposed in cutouts formed in an inner sidewall of the fresh food compartment or formed as a separate housing disposed against the inner side wall of the fresh food compartment. The water dispenser can be combined with an ice maker.

Both of the known external and internal water dispensers thus either require large cutouts in the door or sidewall of the refrigerator liner for placement of the dispenser or take up a large amount of space within the fresh food compartment including internal door space. Also, it is either difficult or impossible to fill large containers, such as pitchers, due to the location or positioning of the known water dispensers with respect to the structure of the refrigerator, and the known internal type solutions force the consumer to open the refrigerator door completely in order to access the water dispenser. These factors make the currently available water dispensers for refrigerators complicated to manufacture and unsuitable for an optimal experience in a typical household.

SUMMARY OF THE INVENTION

However, there is currently no refrigerator appliance, in particular a domestic or home refrigerator appliance, on the market with an internal water dispenser that is integrated with a shelf assembly within the refrigerated or fresh food compartment of the refrigerator appliance.

An apparatus consistent with the present disclosure is directed to providing a shelf-integrated water dispenser for a refrigerator appliance, and to a refrigerator appliance having such a shelf-integrated water dispenser.

An apparatus consistent with the present disclosure is directed to providing a shelf-integrated water dispenser that fits seamlessly into a refrigerator appliance by being integrated seamlessly into the shelf support bracket or railing.

An apparatus consistent with the present disclosure is directed to providing a shelf-integrated water dispenser that has the flexibility of filling containers of any size with filtered water.

An apparatus consistent with the present disclosure is directed to providing a shelf-integrated water dispenser that has a pushed in configuration where the water dispenser does not extend beyond the front edge of the shelf panel and is activated by pressing a smaller container such as a glass or cup against a paddle type activation switch to fill the smaller container, or a pushed out configuration where the water dispenser is extended out beyond the front edge of the shelf panel and is activated by pressing a button type activation switch to fill a large container such as a pitcher.

An apparatus consistent with the present disclosure is directed to providing a shelf-integrated water dispenser configured to use interchangeable aerators having different flow streams or patterns (e.g., laminar stream, Mikado stream, or the like).

An apparatus consistent with the present disclosure is directed to providing a shelf-integrated water dispenser configured to illuminate a laminar flow stream or pattern with different colors and to indicate the water filter status (e.g., notify the user that the filter is OK to use, close to needing replacement, or needs to be changed). This can be considered an optional feature.

An apparatus consistent with the present disclosure is advantageous in that all cutouts in the refrigerator liner can be localized to a back wall of the refrigerator appliance, thereby avoiding the refrigerator liner having to be turned on its side to be cut such that the manufacturing process is simplified and the assembly time is reduced. This is in stark contrast to the known internal water dispenser solutions as noted above that require cutouts in the side wall of the refrigerator liner which are costly because they increase the complexity of the manufacturing process due to added time and movement to make the necessary cuts.

An apparatus consistent with the present disclosure is advantageous in that serviceability of the water dispenser is easier due to the shelf assembly's ability to be removed from the refrigerator appliance, such that the door(s) of the fresh food compartment can be closed and the water dispenser unit worked on by the service person outside of the refrigerator appliance. This aspect also offers additional flexibility as the water dispenser unit can be cleaned outside the refrigerator appliance by removing the shelf assembly which includes the water dispenser integrated with the shelf support bracket or railing.

According to one aspect, the present disclosure provides a refrigerator comprising: a fresh food compartment; at least one shelf disposed in the fresh food compartment, the at least one shelf being supported by at least one shelf support bracket; and a water dispenser integrated with the at least one shelf support bracket and accessible from the fresh food compartment.

According to another aspect, the water dispenser integrated with the at least one shelf support bracket is generally centrally located with respect to right and left side walls of the fresh food compartment.

According to another aspect, the water dispenser integrated with the at least one shelf support bracket comprises a push-push mechanism assembly which is configured to dispose the water dispenser in a pushed in condition where the water dispenser does not extend beyond a front edge of the at least one shelf, and is configured to dispose the water dispenser in a pushed out condition where the water dispenser is extended out beyond the front edge of the at least one shelf.

According to another aspect, the water dispenser comprises an activation button that is exposed in the pushed out condition.

According to another aspect, in the pushed out condition, the activation button is activated by pressing the activation button to fill a large container including a pitcher.

According to another aspect, the water dispenser comprises an activation paddle for activation in the pushed in condition. The paddle can also be activated in the pushed out condition as well.

According to another aspect, in the pushed in condition, the activation paddle is activated by pressing a small container including one of a glass or a cup against the activation paddle to fill the small container. As noted above, the paddle can also be activated in the pushed out condition as well.

According to another aspect, the at least one shelf comprises a half width shelf.

According to another aspect, the at least one shelf comprises a full width shelf.

According to another aspect, the at least one shelf support bracket comprises a hollow inner portion, and the water dispenser includes a water dispenser track which is mounted to the push-push mechanism assembly, with the push-push mechanism assembly and the water dispenser track being mounted in the hollow inner portion of the at least one support bracket.

According to another aspect, the water dispenser comprises an interchangeable aerator.

According to another aspect, the interchangeable aerator produces at least one of a laminar flow stream or a Mikado flow stream (or other off-the-shelf flow patterns).

According to another aspect, the interchangeable aerator comprises at least one light element to illuminate the laminar flow stream with a selected color.

According to another aspect, the at least one light element is configured to indicate a water filter status.

According to another aspect, the present disclosure provides a shelf-integrated water dispenser for use in a refrigerator appliance, the shelf-integrated water dispenser comprising: at least one shelf, the at least one shelf being supported by at least one shelf support bracket; and a water dispenser integrated in the at least one shelf support bracket.

According to another aspect, the at least one shelf support bracket comprises a hollow inner portion, and the water dispenser includes a water dispenser track which is mounted to a push-push mechanism assembly, with the push-push mechanism assembly and the water dispenser track being mounted in the hollow inner portion of the at least one support bracket.

According to another aspect, the push-push mechanism assembly is configured to dispose the water dispenser in a pushed in condition where the water dispenser does not extend beyond a front edge of the at least one shelf, and is configured to dispose the water dispenser in a pushed out condition where the water dispenser is extended out beyond the front edge of the at least one shelf.

According to another aspect, the water dispenser comprises an activation button that is exposed in the pushed out condition.

According to another aspect, the water dispenser comprises an activation paddle for activation in the pushed in condition and pushed out condition as well.

According to another aspect, the present disclosure provides a refrigerator comprising: a fresh food compartment; at least one shelf assembly disposed in the fresh food compartment; and a water dispenser integrated within the at least one shelf assembly and accessible from the fresh food compartment.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 1 is a fragmentary, front perspective view showing the inside of a refrigerator appliance including a half width shelf assembly with a shelf-integrated water dispenser located in a fresh food compartment according to an exemplary embodiment consistent with the present disclosure;

FIGS. 2A, 2B, and 2C are various perspective views showing the half width shelf assembly with the shelf-integrated water dispenser in a pushed in condition according to an exemplary embodiment consistent with the present disclosure;

Figure 9:
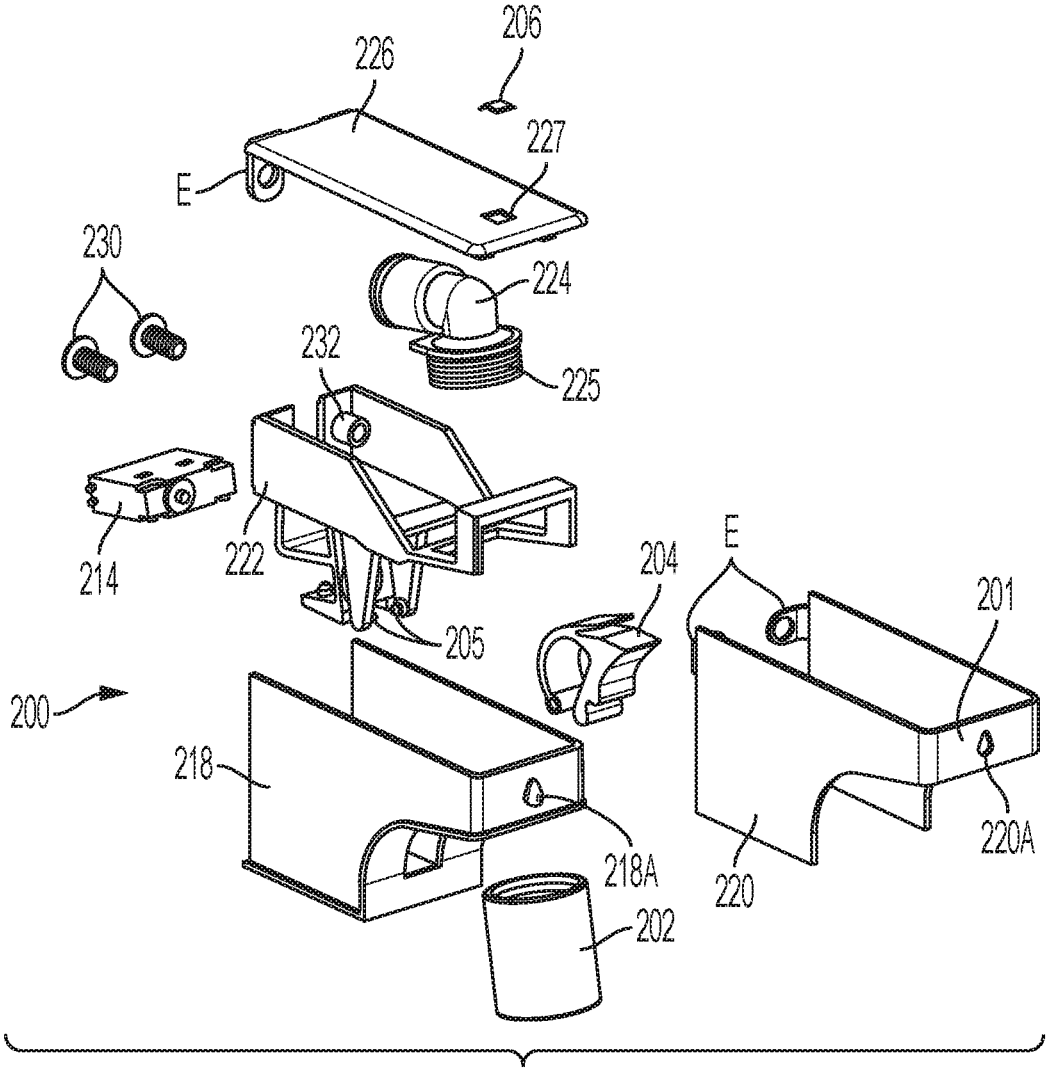
Figure 10A:
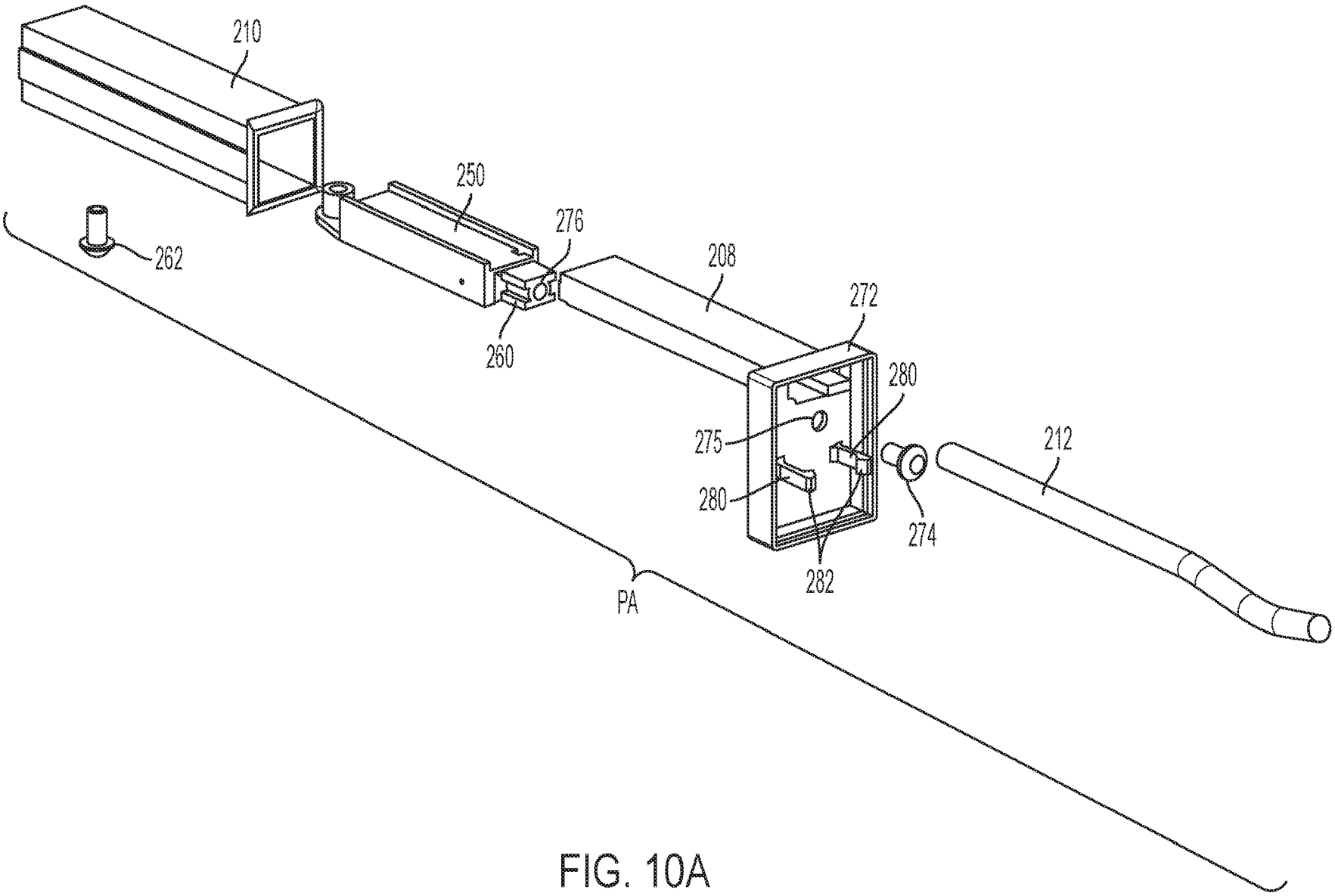
Figure 10B:
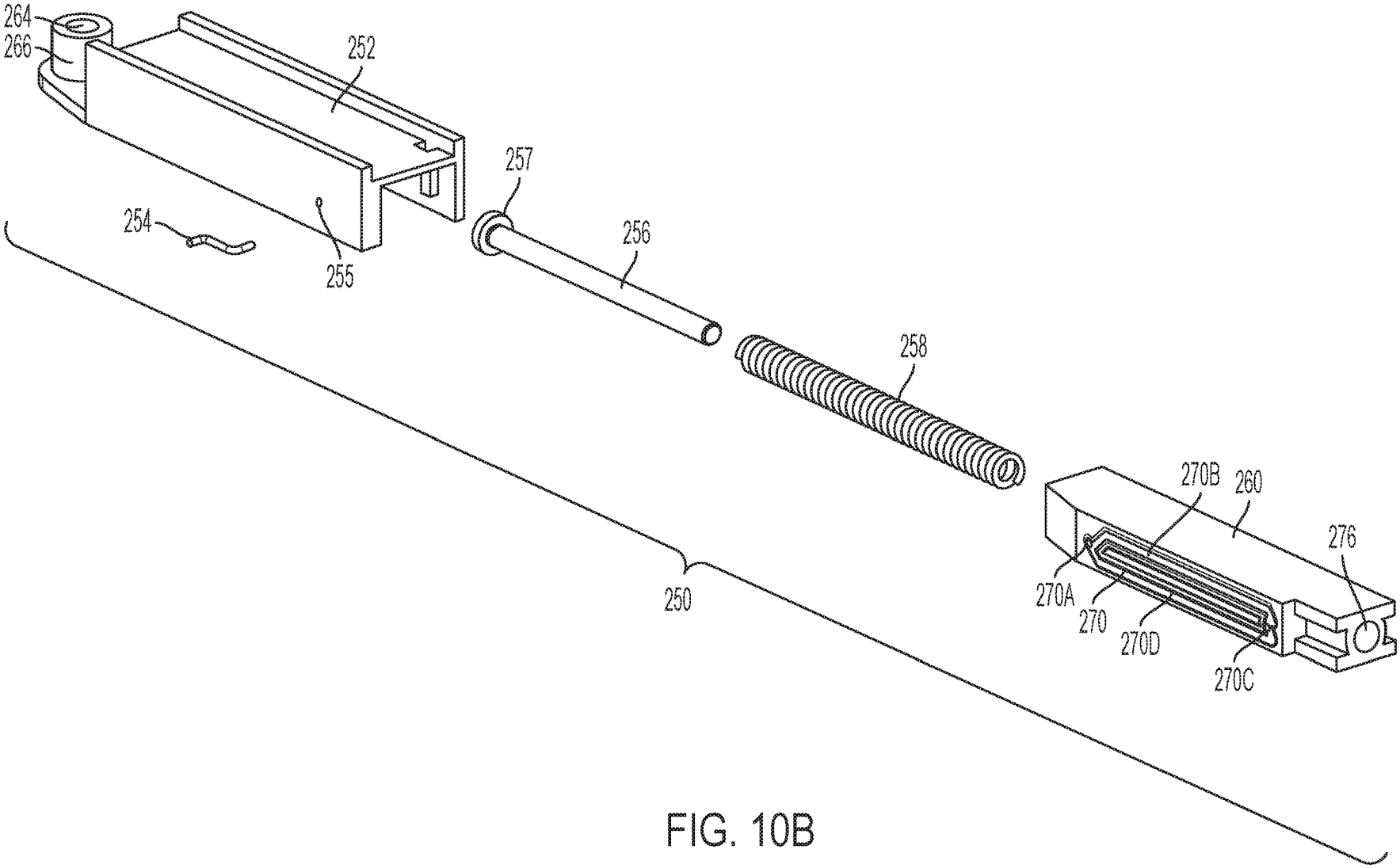
Figure 11A:
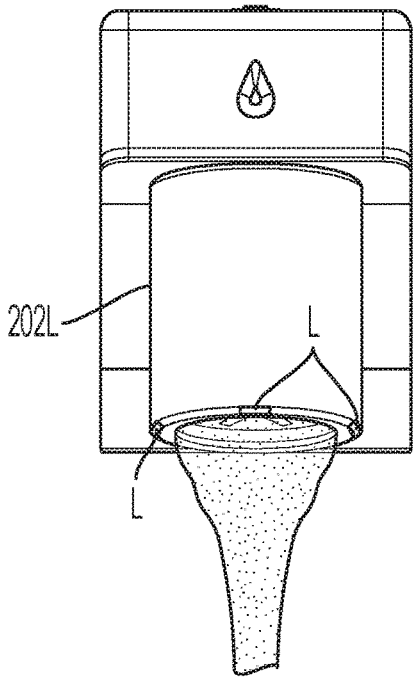
Figure 11B:
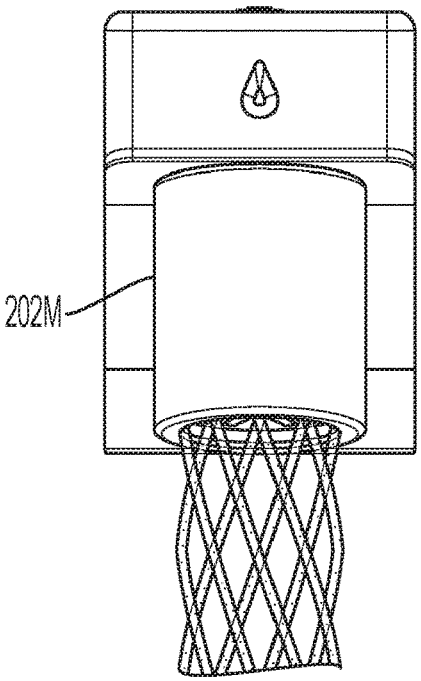
Figure 12A:
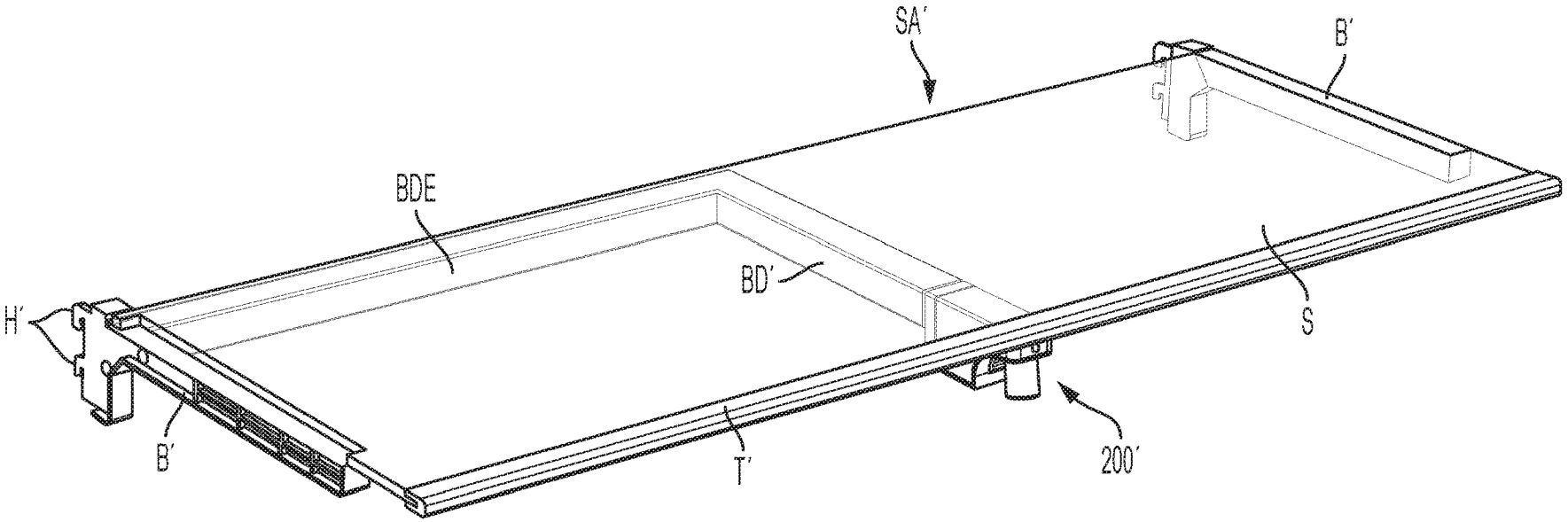
Figure 12B:
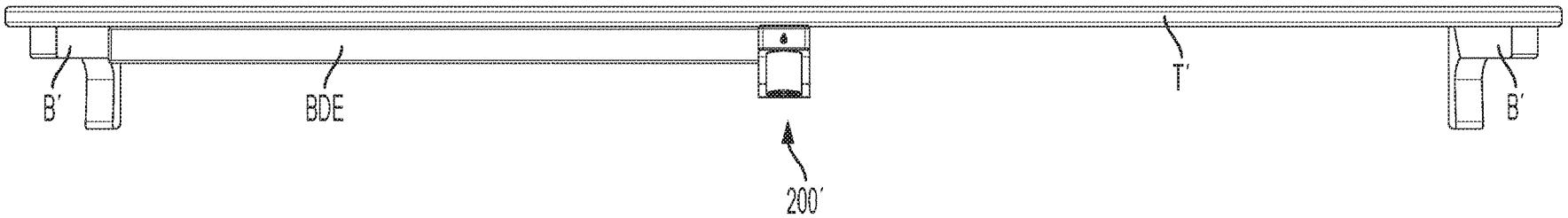
Figure 12C:
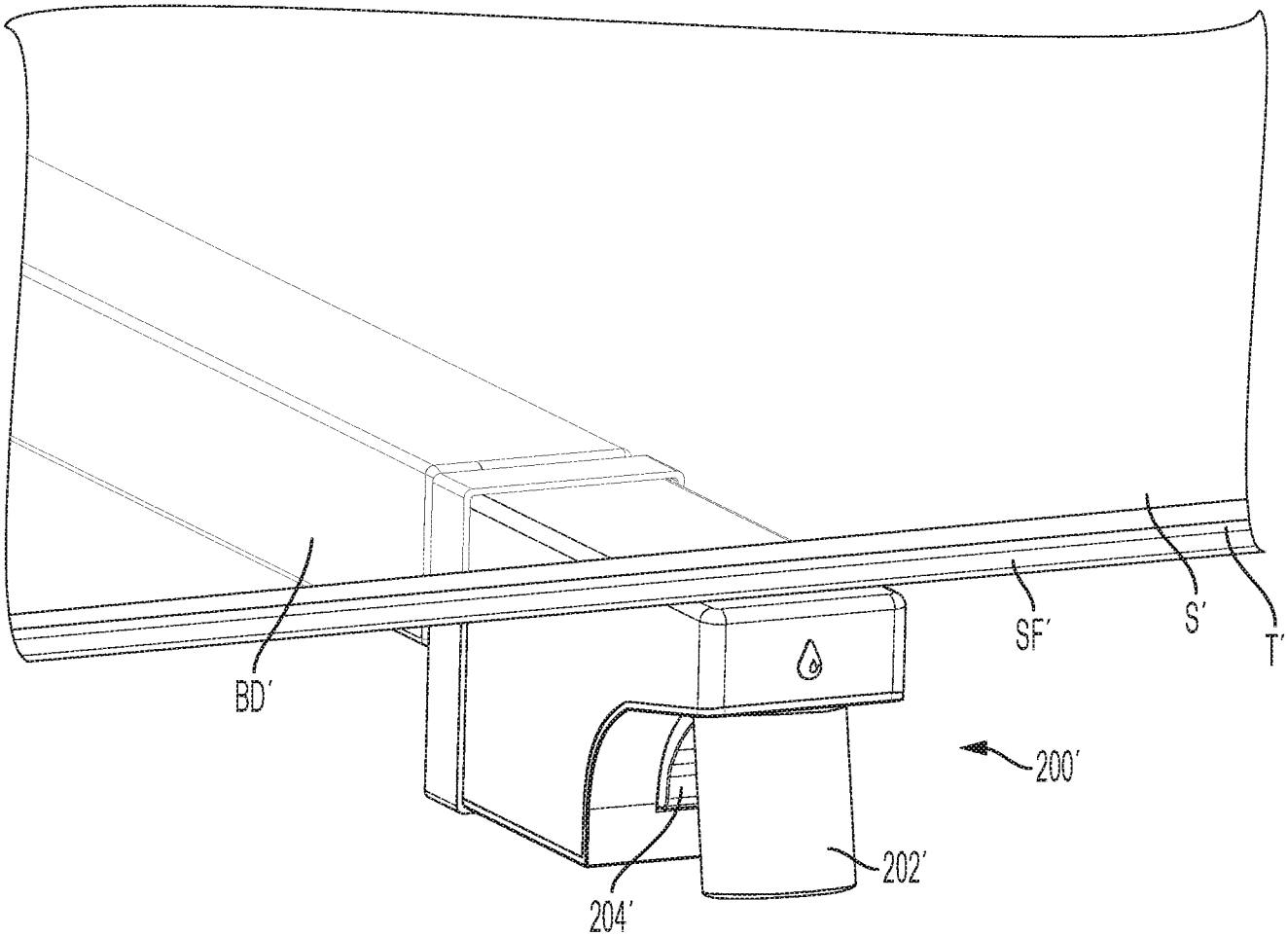

FIGS. 8A, 8B, 8C, and 8D are rear, front, left side, and right side elevational views of the water dispenser according to an exemplary embodiment consistent with the present disclosure;

FIG. 9 is an exploded perspective view of the water dispenser according to an exemplary embodiment consistent with the present disclosure;

FIGS. 10A and 10B are exploded perspective views of the push-push mechanism assembly and the push-push mechanism per se, respectively, of the water dispenser according to an exemplary embodiment consistent with the present disclosure;

FIGS. 11A and 11B are views of exemplary flow streams or patterns of the interchangeable aerator of the water dispenser according to an exemplary embodiment consistent with the present disclosure; and FIGS. 12A, 12B, and 12C are various perspective views of a shelf-integrated water dispenser used on a full width shelf assembly according to another exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

As used herein, the terms "shelf support railing" or "shelf support bracket" refer to structural elements used to support the shelf or shelf panel. The shelf support railing or shelf support bracket is preferably, but not necessarily, formed of metal and includes hooks at the rear for connection to and adjustment along vertical tracks formed by openings such as slots or holes in a wall (e.g., a rear wall) of the refrigeration compartment.

Figure 1:
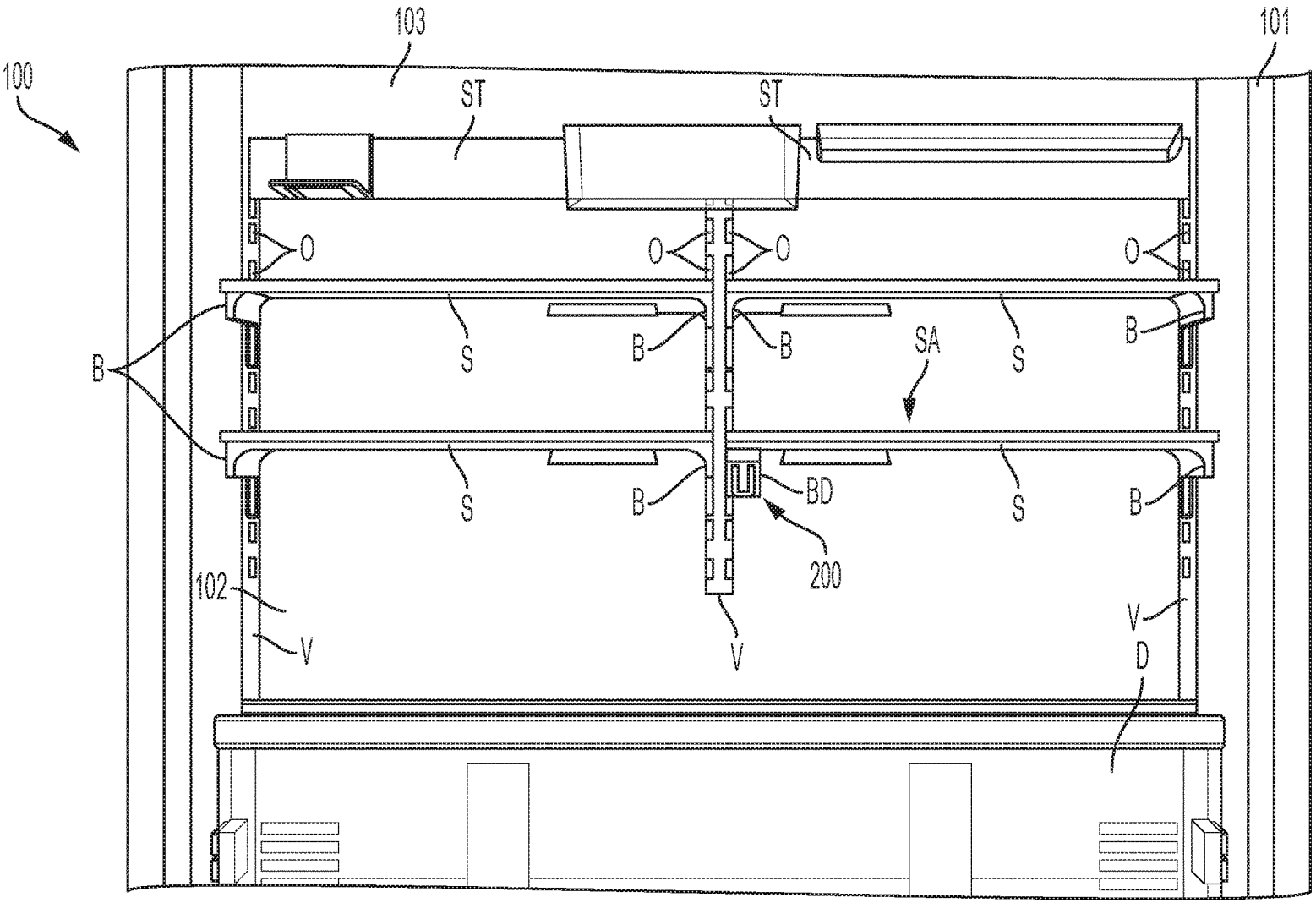

FIG. 1 is a fragmentary, front perspective view showing the inside of a refrigerator appliance 100 including a shelf-integrated water dispenser 200 located in a fresh food compartment 102 according to an exemplary embodiment consistent with the present disclosure. FIG. 1 illustrates the refrigerator appliance 100 with the door(s) removed to reveal the fresh food compartment (also referred to as a refrigeration compartment) 102 according to an exemplary embodiment consistent with the present disclosure. The refrigerator appliance 100 can be, but is not limited to, a French door-bottom mount (FDBM) style refrigerator. More specifically, the refrigerator appliance 100 includes an insulated body 101 having the fresh food compartment 102 located above and being closed by one or two doors (not shown), a freezer compartment (not shown—bottom mount style) covered by a freezer door (not shown) and located below the fresh compartment 102. The fresh food compartment 102 includes, for example, a number of shelves S (in this case half width shelves), an upper tray ST, food racks (not shown) such as in the doors, and a vegetable drawer D. As noted above, the shelves S are supported by shelf support railings or shelf support brackets B (including a shelf support bracket BD having the water dispenser integrated therewith) that include hooks H (see FIGS. 2A and 2B) at the rear for connection to and adjustment along vertical tracks V (in this case three vertical tracks V are shown) formed by separate metal strips having openings such as slots or holes O therein and arranged along a wall (e.g., a rear wall 103) of the refrigeration compartment 102. The fresh food or refrigeration compartment 102 is typically set in a range of 1° C. to 4° C., and the freezer compartment is typically set at −18° C. or colder.

Figure 2A:
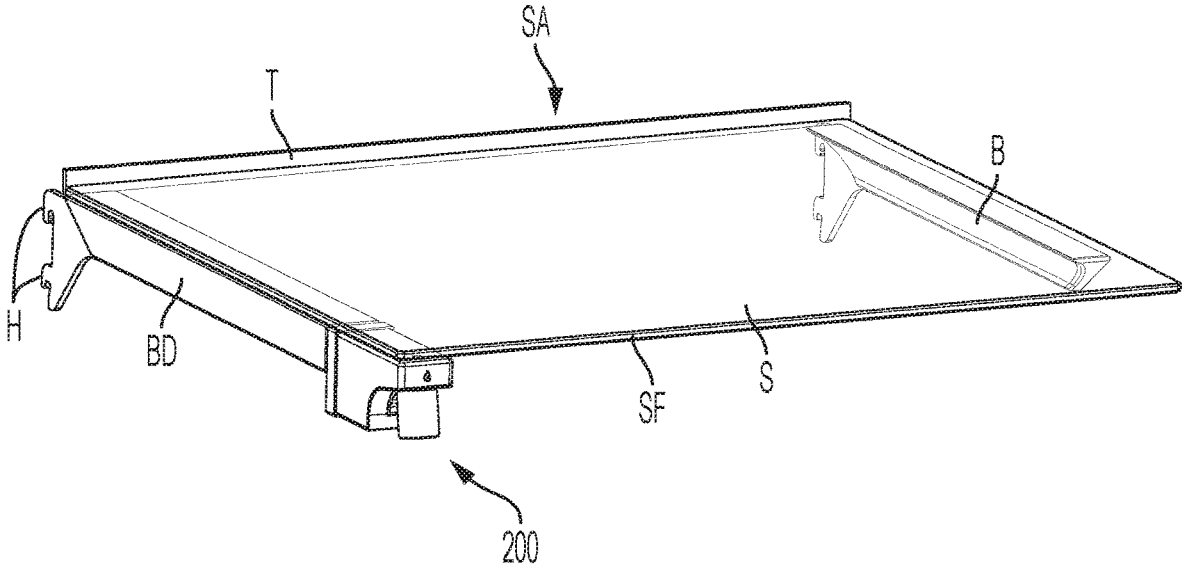
Figure 2B:
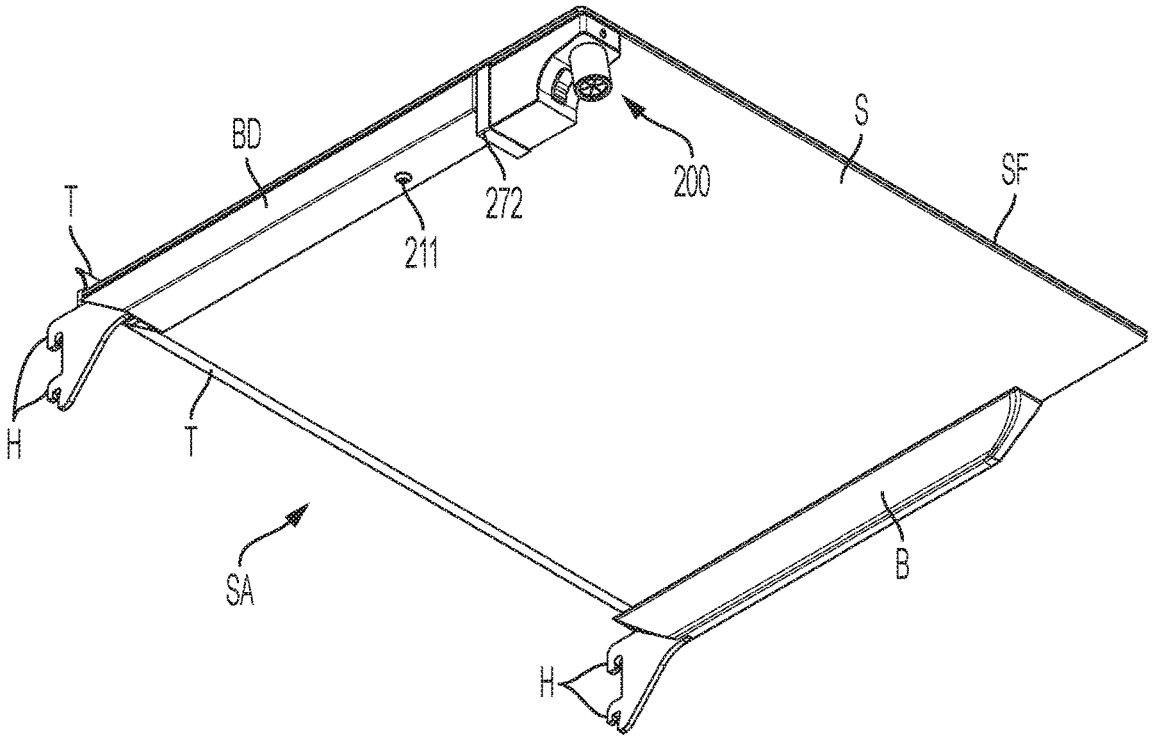
Figure 2C:
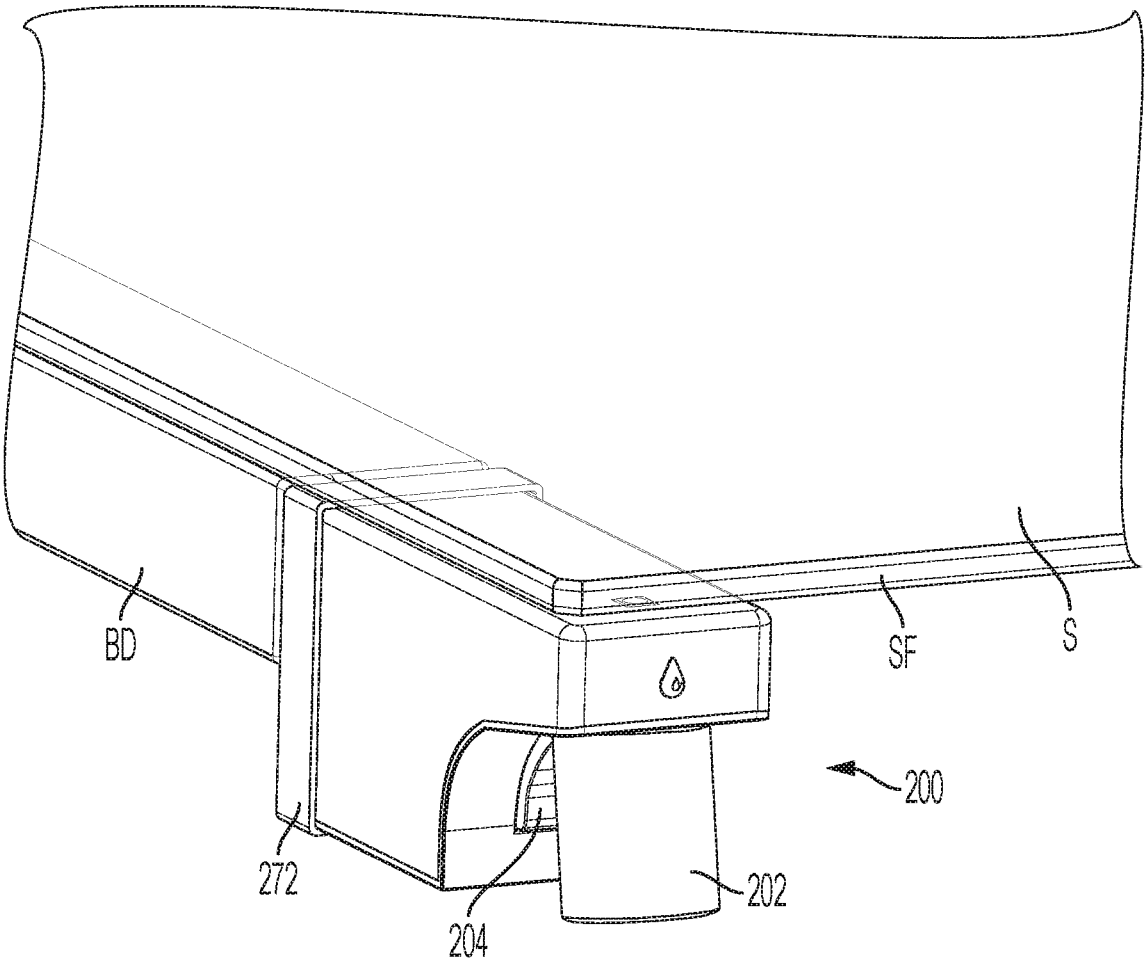
Figure 3A:
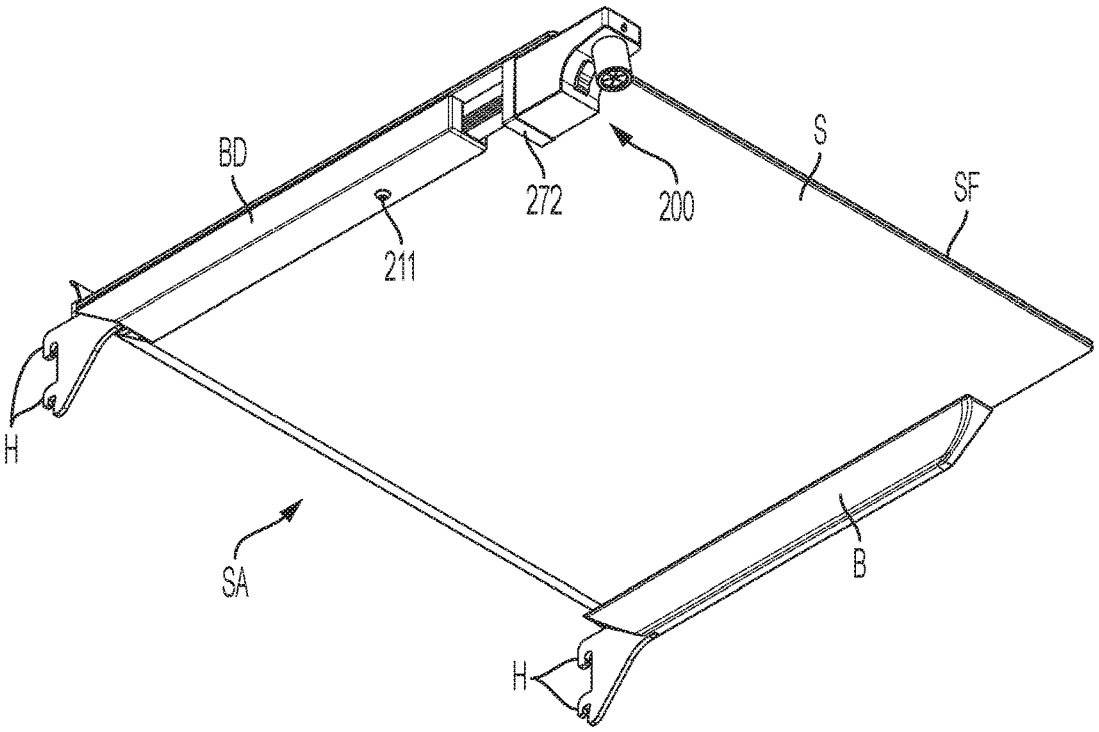
FIGS. 3A and 3B are various perspective views showing the half width shelf assembly with the shelf-integrated water dispenser in a pushed out condition according to an exemplary embodiment consistent with the present disclosure.
Figure 3B:
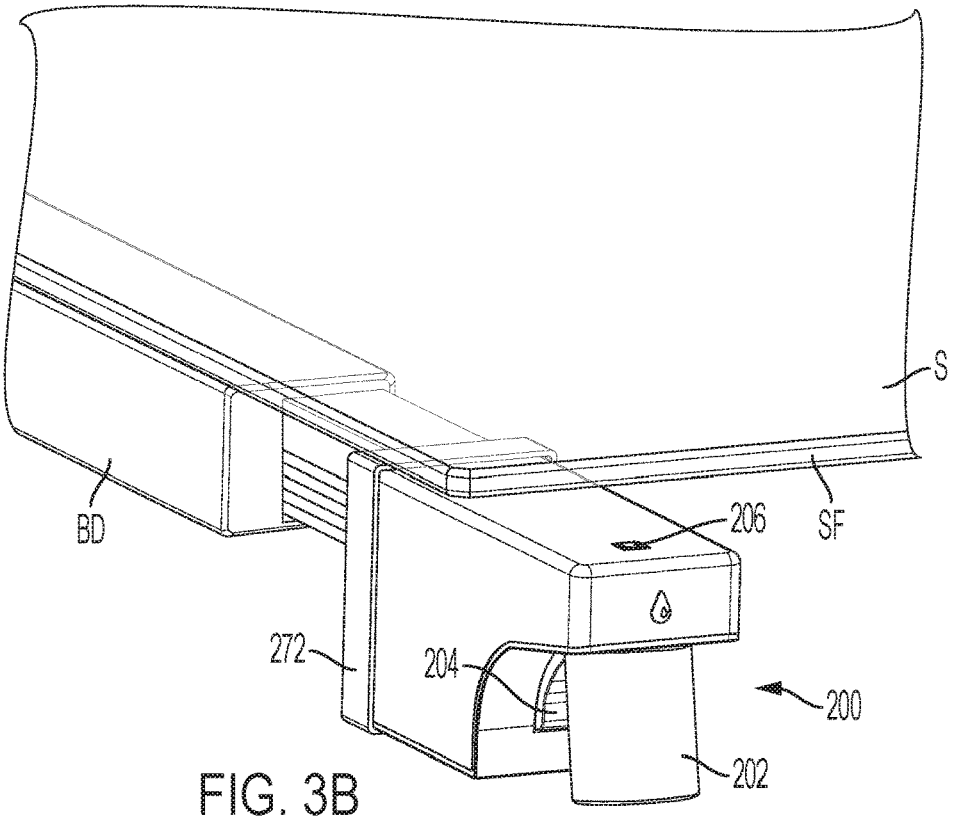
Figure 4:
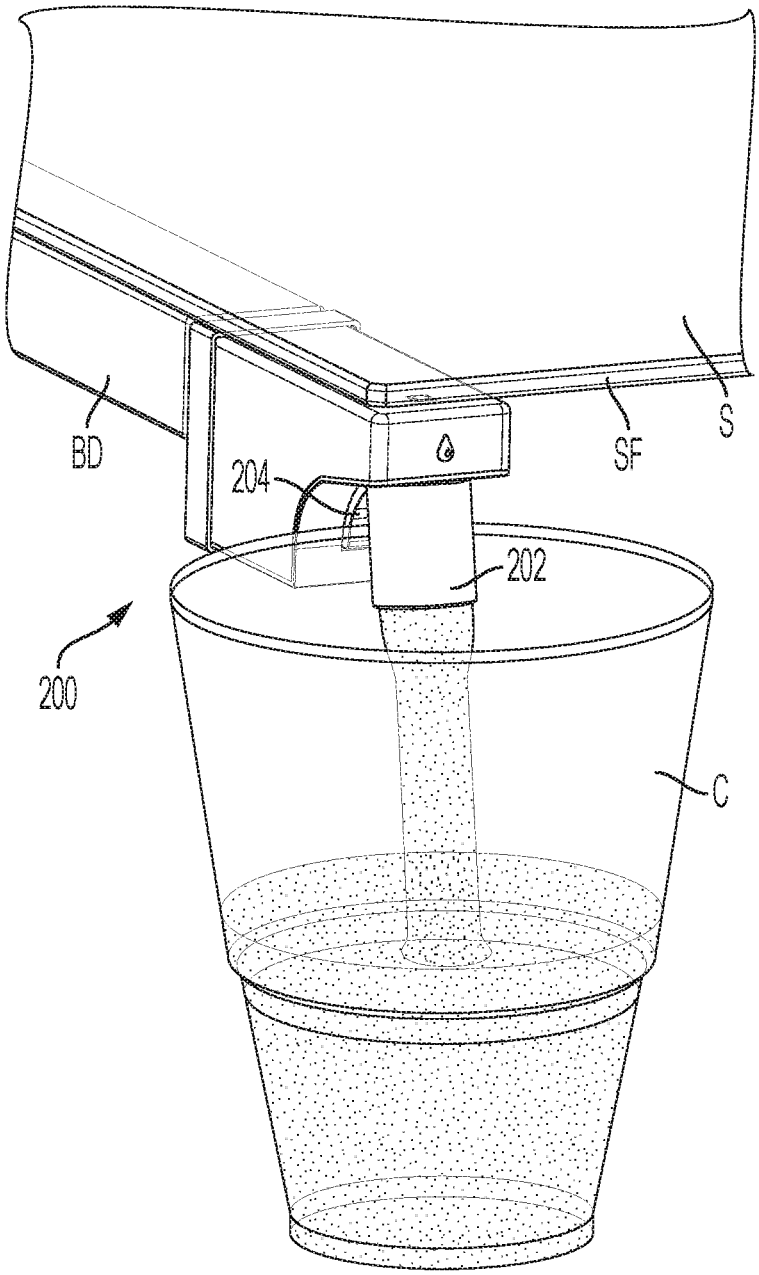
FIG. 4 is a perspective view of the shelf-integrated water dispenser showing paddle activation with a glass or cup according to an exemplary embodiment consistent with the present disclosure.
Figure 5:
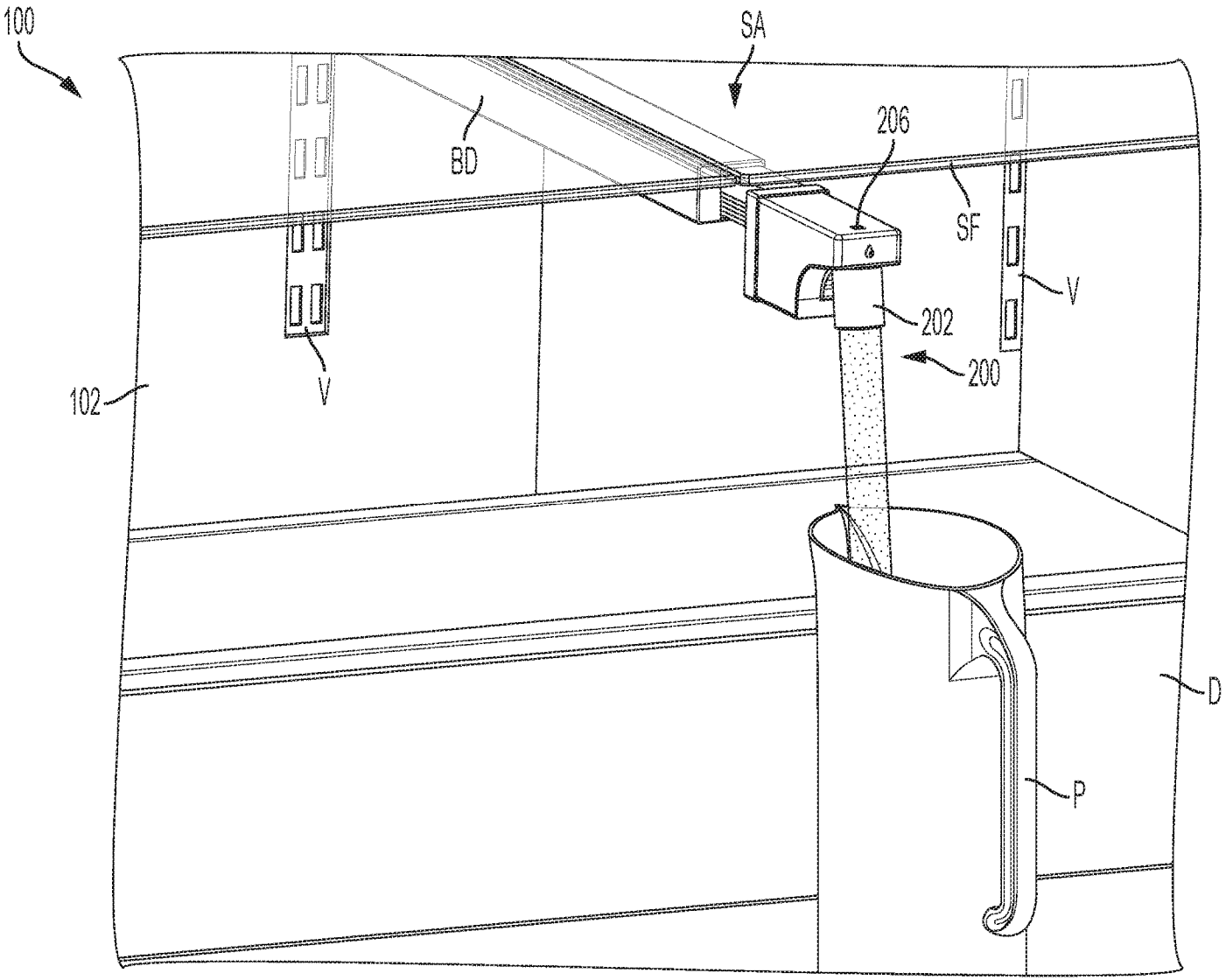
FIG. 5 is a perspective view of the shelf-integrated water dispenser showing button activation for filling a container such as a pitcher, sports bottle, or larger container according to an exemplary embodiment consistent with the present disclosure.

FIGS. 2A, 2B, 2C, and 4 are various perspective views showing the half width shelf assembly SA with the shelf-integrated water dispenser 200 in a pushed in condition where the water dispenser 200 does not extend beyond the front edge SF of the shelf panel S and is activated by pressing a smaller container such as a glass or cup against a paddle type activation switch to fill the smaller container according to an exemplary embodiment consistent with the present disclosure, while FIGS. 3A, 3B, and 5 are various perspective views showing the half width shelf assembly SA with the shelf-integrated water dispenser 200 in a pushed out condition where the water dispenser 200 is extended out beyond the front edge SF of the shelf panel S and is activated by pressing a button type activation switch (also a capacitive type switch activation) to fill a large container such as a pitcher according to an exemplary embodiment consistent with the present disclosure. Aspects of the shelf-integrated water dispenser assembly WA (see FIG. 6B) will be discussed in more detail below in connection with FIGS. 6A-9, whereas aspects of the push-push mechanism assembly PA will be discussed in more detail below in connection with FIGS. 10A and 10B of the drawings.

As shown in FIGS. 2A, 2B, and 2C, the half width shelf assembly SA includes a shelf or shelf panel S typically formed of, for example, a tempered glass panel, although other materials such as plastic can be used. The shelf panel S is supported by at least one shelf support railing or bracket (B, BD), with the shelf support bracket BD having the shelf-integrated water dispenser 200 associated therewith. In this exemplary embodiment, the shelf support bracket B is shown on the right side of the shelf panel S and the shelf support bracket BD having the shelf-integrated water dispenser 200 associated therewith is shown on the left side of the shelf panel S. Preferably, the half width shelf assembly SA is arranged in the fresh food compartment 102 as shown in FIG. 1 such that the shelf support bracket BD having the shelf-integrated water dispenser 200 is generally centrally located with respect to right and left side walls of the fresh food compartment 102 to ensure an optimal user experience especially when filling large containers, as will be discussed in more detail below with respect to FIG. 5. The half width shelf assembly SA can further include a rear shelf trim T. The shelf panel S is adhered to the upper flat surfaces (see F1 and F2 in FIG. 6A) of the shelf support brackets B and BD using a suitable adhesive such as an ultraviolet (UV) cured adhesive or a pressure sensitive adhesive (PSA) tape. Although shelf support brackets B are shown on the right side and left side of the refrigerator appliance 100, the inner wall and/or the rear wall 103 of the liner of the refrigerator appliance 100 could also be formed with projections instead of the shelf support brackets B to provide support for the shelf panels S.

As best shown in the enlarged perspective view of FIG. 2C, the water dispenser 200 is shown in a pushed in state so that the water dispenser 200 does not extend beyond the front edge SF of the shelf panel S. The water dispenser 200 includes an aerator 202 and an activation paddle 204, as will be discussed in more detail below. While in the pushed in state, a user can easily activate the water dispenser 200 with a glass or cup C (or any type of smaller container) by simply pressing the glass or cup C against the activation paddle 204, as shown in FIG. 4.

With reference to FIGS. 3A, 3B, and 5, the water dispenser 200 is shown in a pushed out state so that the water dispenser 200 extends beyond the front edge SF of the shelf panel S. As shown in FIG. 5, in this pushed out state, a user can activate the water dispenser 200 for filling a pitcher P (or any type of larger container) or sports bottle by simply pressing the button switch 206 located, for example, on top of the water dispenser 200, as shown in FIGS. 3B and 7B. Also, with the water dispenser 200 pushed out beyond the front edge SF of the shelf panel S, a user can easily position a large container such as the pitcher P below the aerator 202 of the water dispenser 200, as is apparent in FIG. 5.

Figure 6A:
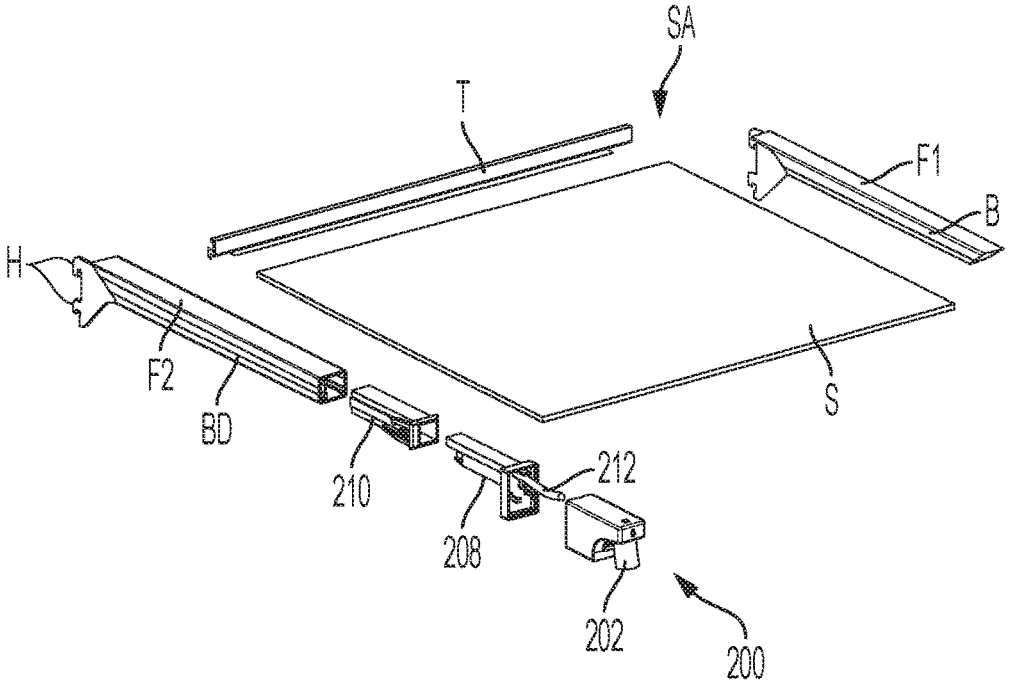
FIGS. 6A and 6B are exploded perspective views showing the water dispenser assembly with the shelf assembly and as part of the shelf support bracket, respectively, according to an exemplary embodiment consistent with the present disclosure.
Figure 6B:
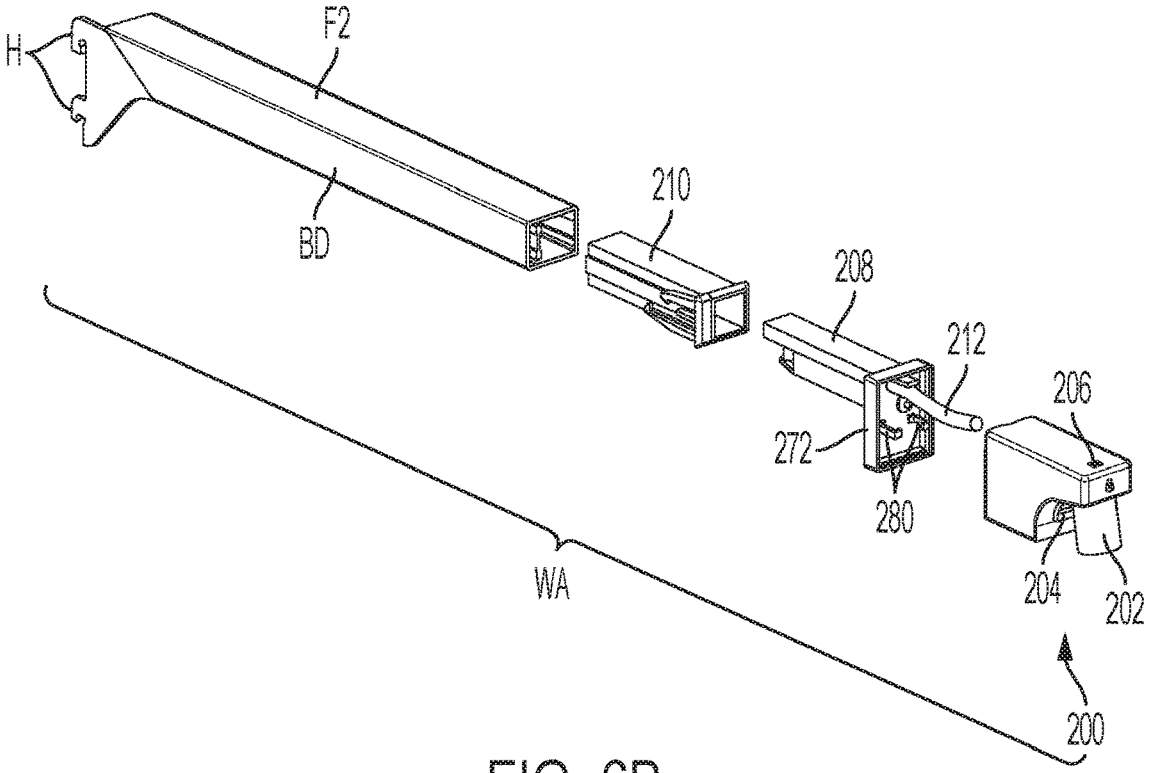

A detailed description will now be made of the shelf-integrated water dispenser assembly WA (see FIG. 6B) in connection with FIGS. 6A-9. In particular, the shelf-integrated water dispenser assembly WA comprises the water dispenser 200, a push-push mechanism assembly/water dispenser track 208, and a push-push mechanism/water dispenser track housing 210 as shown in FIGS. 6A and 6B. The water dispenser 200 is configured to be mounted on the front end portion (see front plate 272) of the push-push mechanism assembly/water dispenser track 208 to be movable therewith. The push-push mechanism assembly/water dispenser track 208 is in turn slidably mounted within the push-push mechanism/water dispenser track housing 210. The push-push mechanism/water dispenser track housing 210 is fixed within a hollow inner portion of the shelf support bracket BD by a fastener such as a screw or bolt 211 (see FIGS. 2B and 3A).

Figure 7A:
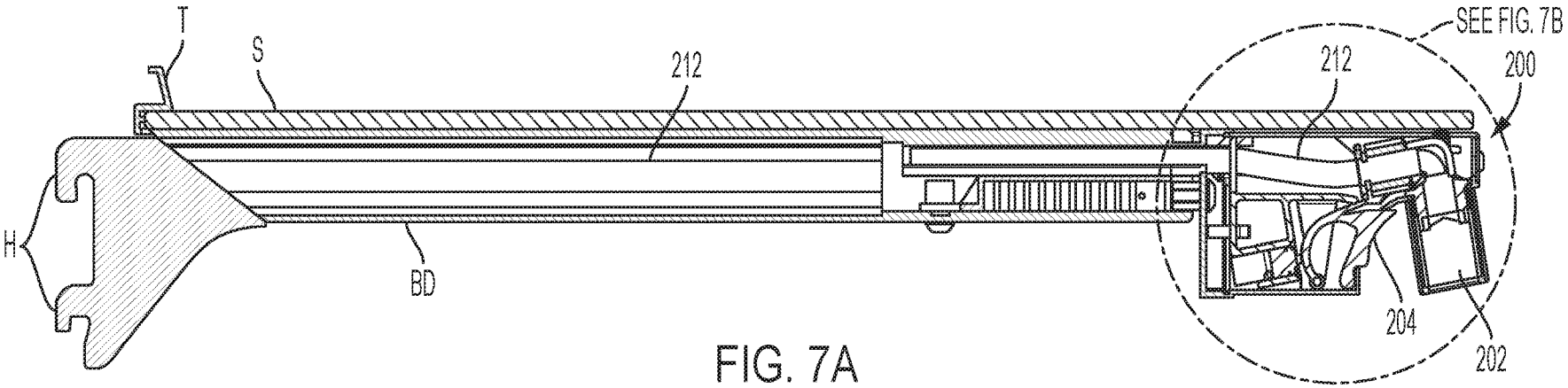
FIG. 7A is an enlarged sectional view through the water dispenser according to an exemplary embodiment consistent with the present disclosure.
Figure 7B:
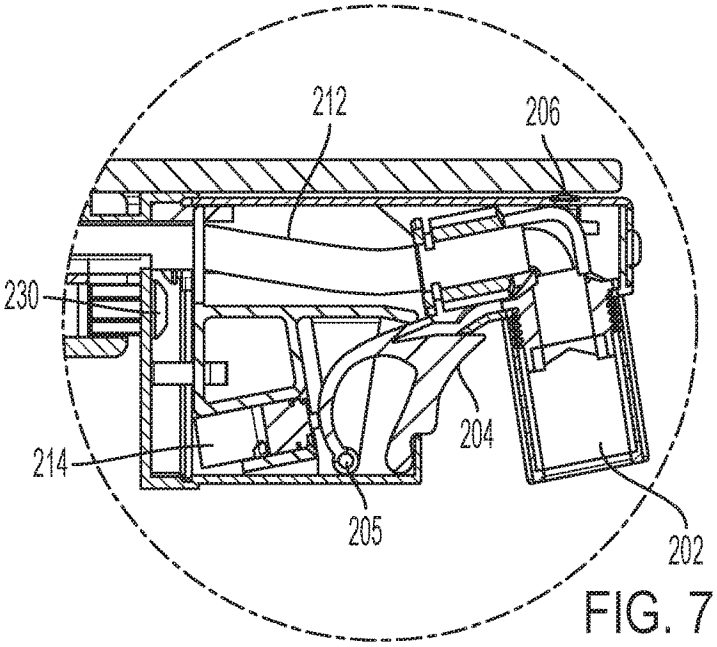
FIG. 7B is a sectional view through the water dispenser, water pipe, and shelf support bracket according to an exemplary embodiment consistent with the present disclosure.
Figure 8A:
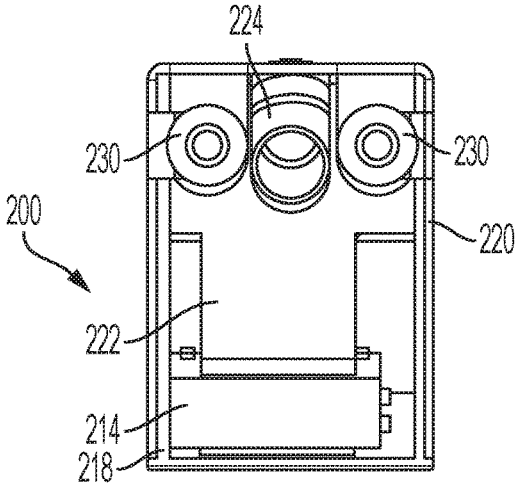
Figure 8B:
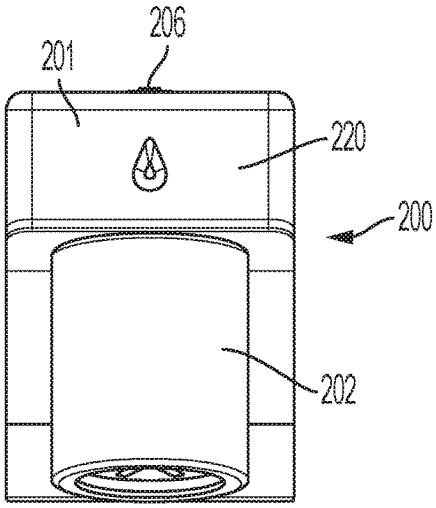
Figure 8C:
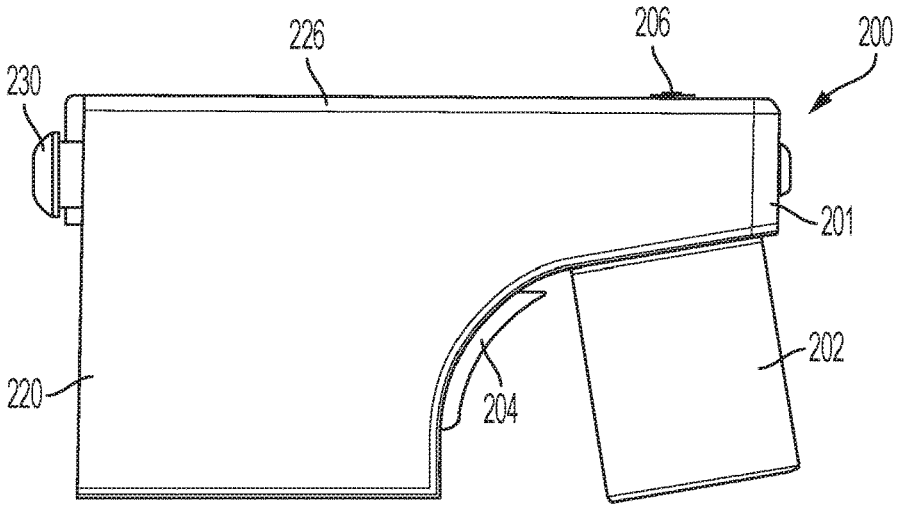
Figure 8D:
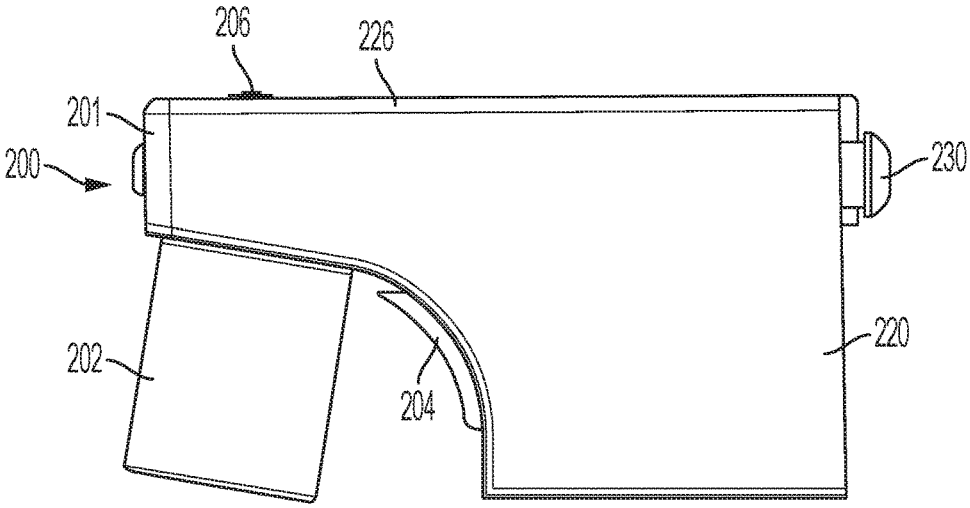

FIGS. 7A and 7B are sectional views through the water dispenser 200, a water supply pipe 212, and shelf support bracket BD according to an exemplary embodiment consistent with the present disclosure. In particular, the activation paddle 204 of the dispenser 200 is configured to actuate an electrical switch mechanism such as a Nano-switch 214. The water supply pipe 212 extends to the back of the shelf support bracket BD where the water supply pipe 212 is connected to the water piping of an ice and water system assembly (not shown) in the refrigerator appliance 100 using a quick pipe connect/disconnect (not shown). U.S. Pat. No. 3,570,266 (Alvarez et al.) which is incorporated herein by reference shows a suitable quick pipe connect/disconnect that could be used. Also, a suitable electrical quick connect/disconnect (not shown) for the wiring leading to the dispenser is described in U.S. Pat. No. 5,279,448 (Hanlin et al.) which is incorporated herein by reference. Accordingly, the serviceability of the water dispenser 200 is easier due to the shelf assembly's SA ability to be removed from the refrigerator appliance 100. This aspect also offers additional flexibility as the water dispenser 200 can be cleaned outside the refrigerator appliance 100 by removing the shelf assembly SA which includes the water dispenser 200 integrated with the shelf support bracket or railing BD.

FIGS. 8A, 8B, 8C, and 8D are rear, front, left side and right side elevational views of the water dispenser 200 per se, and FIG. 9 is an exploded perspective view of the water dispenser 200 according to an exemplary embodiment consistent with the present disclosure. As shown in the exploded view of FIG. 9, the water dispenser 200 comprises an outer housing 218, an outer housing trim 220 (preferably formed of stainless steel) that fits over the outer housing 218. The outer housing 218 has a teardrop-shaped projection 218A at a front portion 201 thereof and the outer housing trim 220 has a teardrop-shaped opening 220A that fits over and snaps on to the teardrop-shaped projection 218A. The outer housing 218 and the outer housing trim 220 are configured to house an internal frame 222. The internal frame 222 is configured to mount thereon the Nano switch 214 and the activation paddle 204, as well as a quick-connect water connector 224 which connects to a front portion of the water supply pipe 212 (see FIGS. 6A, 6B, 7A, and 7B). The activation paddle 204 is pivotally mounted on opposing shafts 205 protruding at a bottom portion of the internal frame 222. The interchangeable aerator 202 has a threaded connection for screwing the aerator 202 onto a threaded end portion 225 of the quick-connect water connector 224. A top cover plate 226 is configured to cover the outer housing 218. The top cover plate 226 can be made of plastic or preferably glass. The top cover plate 226 has an opening 227 formed therein for receiving the button switch 206. The switch 206 can be, for example, a tactical or capacitive type switch. If the switch 206 is a capacitive switch, then the opening 227 is not required. The outer housing trim 220 and the top cover plate 226 have eyelets E for receiving suitable fasteners such as screws or bolts 230 in order to fasten the outer housing trim 220, the outer housing 218 (which is snapped together with the outer housing trim 220 via the teardrop-shaped projection 218A), and the top cover plate 226 to the internal frame 222 at the rear portion through the use of bores 232 (only one of which is visible in FIG. 9). FIGS. 8A-8D show the assembled water dispenser 200 per se.

A detailed description will now be made of the push-push mechanism assembly PA in connection with FIGS. 10A and 10B. In particular, as shown in FIG. 10A, the push-push mechanism assembly PA comprises the push-push mechanism/water dispenser track housing 210, a push-push mechanism 250, the water dispenser track 208, and the water supply pipe 212. FIG. 10B shows an enlarged view of the push-push mechanism 250 per se. The push-push mechanism 250 comprises a push-push housing 252, a push-push guiding pin 254, a push-push assembly pin 256, a push-push spring 258, and a push-push drive pin or block 260. In particular, the push-push housing 252 is fixed inside the hollow push-push mechanism/water dispenser track housing 210 using a suitable fastener such as a screw or bolt 262 that is inserted into a hole 264 formed by the boss 266 located at the rear end portion of the push-push housing 252. The fastener 262 passes through a hole (not shown) in the bottom of the hollow push-push mechanism/water dispenser track housing 210 and is tightened into the hole 264. The push-push assembly pin 256 has a head 257 at the rear end thereof, and the push-push spring 258 fits over the push-push assembly pin 256 and abuts the head 257 which in turn rests against the internal back wall (not shown) of the push-push housing 252. The push-push assembly pin 256 and the push-push spring 258 fit into a bore (not shown) formed in the push-push drive pin or block 260. The push-push drive pin or block 260 is slidably disposed in the push-push housing 252 and guided by the push-push guiding pin 254 which has a generally S-shape and engages with a guide slot or track 270 which has the form of a closed loop that is formed on the side of the push-push drive pin or block 260. The guide track 270 includes resting or stop points 270A, 270C formed by recesses at both ends and upper and lower straight track portions 270B, 270D which extend between the back and front of the drive block 260 and communicate with the stop points 270A and 270C via angled track portions. The push-push drive pin or block 260 is spring-biased by the push-push spring 258 in a direction away from or exiting the push-push housing 252 while being guided by the push-push guiding pin 254. The push-push guiding pin 254 passes through a hole 255 that passes through the side wall of the push-push housing 252. The water dispenser track 208 is slidably disposed over the top of the push-push housing 252, and the front plate 272 of the water dispenser track 208 is fastened to the front of the push-push drive pin or block 260 through the use of a suitable fastener such as a screw or bolt 274 that passes through a hole 275 and is threaded into a bore 276 in the front end of the push-push drive pin or block 260. The front plate 272 of the water dispenser track 208 also serves as the rear cover of the outer housing 218 of the water dispenser 200 and is connected to the outer housing 218 using a pair of arms 280 having catches 282.

In operation of the push-push mechanism assembly PA, when a user wants to bring the water dispenser 200 into a pushed out state, the user simply pushes in slightly on the outer housing 218 at the front portion 201 (see FIG. 8B) of the water dispenser 200 which in turn moves the push-push guiding pin 254 down and out of the stop point or recess 270C so that the push-push guiding pin 254 can travel in the lower straight portion of the track 270D and the water dispenser 200 is then released and the push-push spring 258 biases the water dispenser 200 outward to project beyond the front edge SF of the shelf S. When the push-push guiding pin 254 reaches the stop point or recess 270A, the push-push guiding pin 254 serves to control the outward travel distance of the water dispenser 200. Likewise, when the user wants to return the water dispenser 200 to the pushed in state again, the user simply pushes in on outer housing 218 of the water dispenser 200 against the spring force or bias of the push-push spring 258 which in turn moves the push-push guide pin 254 up and out of the stop point or recess 270A, so that the push-push guide pin 254 can travel in the upper straight portion of the track 270B to the end at which point the spring force will push the push-push guide pin 254 down into the stop point or recess 270C. In this way, the water dispenser 200 is retained against the bias of the push-push spring 258 by the push-push guiding pin 254 being held in the stop point or recess 270C, such that the water dispenser 200 is again pushed in so as not to project beyond the front edge SF of the shelf S. Accordingly, with the push-push guiding pin 254 sliding within the guide slot or track 270 with respect to the spring force or bias of the push-push spring 258 as described above, a push-push effect is obtained that is pleasant to the user, as the user positions the dispenser 200 to either the pushed in position or the pushed out position.

FIGS. 11A and 11B are views of exemplary flow streams or patterns of the interchangeable aerator 202 of the water dispenser 200 according to an exemplary embodiment consistent with the present disclosure. In particular, FIG. 11A shows an interchangeable aerator 202L which produces a laminar flow stream or pattern, whereas FIG. 11B shows an interchangeable aerator 202M which produces a Mikado flow stream or pattern. Of course, these are only two examples, and other flow patterns are possible. The various interchangeable aerators 202L, 202M, etc., can be easily changed by the user by simply unscrewing the current aerator 202 from the threaded end portion 225 of the quick-connect water connector 224 and replacing it with another aerator 202 which may have a different flow pattern. The aerator 202 reduces or eliminates any water dripping from the dispenser 200, with such water dripping being a problem with current internal water dispensers. The present disclosure also contemplates a shelf-integrated water dispenser 200 configured to illuminate the laminar flow stream or pattern with different colors and to indicate the water filter status (e.g., notify the user that the filter is OK to use, close to needing replacement, or needs to be changed). For example, a plurality of light elements L, such as light emitting diodes (LEDs) can be disposed on or trimmed around the laminar flow aerator 202L in order to illuminate the laminar flow stream or pattern with different colors as selected by the user. Internal fiber optic lighting could also be used. Moreover, certain colors of light could be used only for indicating the status of the water filter. For example, a red light can be used to indicate that the filter needs to be changed. Moreover, a separate light can be disposed, for example, on the front of the water dispenser 200 for indicating the status of the water filter.

Although not shown, the water dispensed by the water dispenser 200 is preferably filtered by a suitable water filter. The water filter location is normally determined depending on the particular type of refrigerator appliance 100 in which the water dispenser and filter are employed. The water filter, water valve, water supply tank, and a check valve, typically in that order, are part of a standard ice and water system assembly (not shown) disposed before the water dispenser 200. The water filter is typically connected to the pressurized home water supply and the ice and water system assembly is connected at the other end after the check valve to the water supply pipe 212 of the water dispenser 200. Typically, the water filter is located in the top right or left corner of the refrigeration or fresh food compartment in an FDBM type model, and is located in the machine compartment of certain built-in type models. The water valve (not shown) can be, for example, a solenoid operated water valve and is used to turn ON and OFF the supply of water to the water supply pipe 212 when either the activation paddle 204 or activation button 206 is actuated by the user. The solenoid operated water valve is included as part of the above-noted ice and water system assembly which is connected to the pressurized home water supply, and the wiring (not shown) from the Nano switch 214 for the activation paddle 204 and from the activation button switch 206 passes through the shelf support railing or bracket BD and connects to the solenoid operated water valve via the electrical quick connect/disconnect (noted above) at the back of the shelf support railing or bracket BD or shelf assembly SA.

FIGS. 12A, 12B, and 12C are various perspective views of a shelf-integrated water dispenser used on a full width shelf assembly SA' according to another exemplary embodiment consistent with the present disclosure. In particular, the full width shelf assembly SA' includes a shelf or shelf panel S' formed of a tempered glass panel or plastic panel. The shelf panel S' is supported by at least one shelf support railing or bracket (B', BD'), with the shelf support bracket BD' having the shelf-integrated water dispenser 200' associated therewith. In this further exemplary embodiment, the shelf support brackets B' are shown on the right side and the left side of the shelf panel S' and the shelf support bracket BD' having the shelf-integrated water dispenser 200' associated therewith is shown in the center of the shelf panel S'. The front edge SF' of the shelf panel S' can have a trim piece T' thereon for aesthetic purposes. The shelf support bracket BD' having the shelf-integrated water dispenser 200' associated therewith can have an extension conduit channel portion BDE at the rear which runs perpendicular to the shelf support bracket BD' and can conceal any piping and/or wiring.

The present invention has substantial opportunity for variation without departing from the spirit or scope of the present invention. For example, while FIG. 1 shows an FDBM style refrigerator appliance 100, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Moreover, while the shelf-integrated water dispenser 200 has been described with reference to a water dispenser integrated seamlessly with a shelf support bracket in the fresh food compartment, the present disclosure also contemplates other configurations such as, but not limited to, integrating the water dispenser into other parts of the shelf assembly instead of the shelf support bracket. For example, the shelf panel could be in the form of a plastic shelf/drawer combination or a tray, and the water dispenser integrated seamlessly into or within the same. Still further, the water dispenser could be seamlessly integrated as part of a plastic shelf panel. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

a fresh food compartment;

at least one shelf disposed in the fresh food compartment, the at least one shelf being supported by at least one shelf support bracket; and a water dispenser integrated with the at least one shelf support bracket so as to form at least a portion of the at least one shelf support bracket, the water dispenser being accessible from inside the fresh food compartment.

2. The refrigerator of claim 1, wherein the water dispenser integrated with the at least one shelf support bracket is generally centrally located with respect to right and left side walls of the fresh food compartment.

3. The refrigerator of claim 1, wherein the water dispenser integrated with the at least one shelf support bracket comprises a push-push mechanism assembly which is configured to dispose the water dispenser in a pushed in condition where the water dispenser does not extend beyond a front edge of the at least one shelf, and is configured to dispose the water dispenser in a pushed out condition where the water dispenser is extended out beyond the front edge of the at least one shelf.

4. The refrigerator of claim 3, wherein the water dispenser comprises an activation button that is exposed in the pushed out condition.

5. The refrigerator of claim 4, wherein in the pushed out condition, the activation button is activated by pressing the activation button to fill a large container including a pitcher.

6. The refrigerator of claim 3, wherein the water dispenser comprises an activation paddle for activation in the pushed in condition.

7. The refrigerator of claim 6, wherein in the pushed in condition, the activation paddle is activated by pressing a small container including one of a glass or a cup against the activation paddle to fill the small container.

8. The refrigerator of claim 1, wherein the at least one shelf comprises a half width shelf.

9. The refrigerator of claim 1, wherein the at least one shelf comprises a full width shelf.

10. The refrigerator of claim 3, wherein the at least one shelf support bracket comprises a hollow inner portion, and the water dispenser includes a water dispenser track which is mounted to the push-push mechanism assembly, with the push-push mechanism assembly and the water dispenser track being mounted in the hollow inner portion of the at least one support bracket.

11. The refrigerator of claim 1, wherein the water dispenser comprises an interchangeable aerator.

12. The refrigerator of claim 11, wherein the interchangeable aerator produces at least one of a laminar flow stream or other flow stream.

13. The refrigerator of claim 12, wherein the interchangeable aerator comprises at least one light element to illuminate the laminar flow stream with a selected color.

14. The refrigerator of claim 13, wherein the at least one light element is configured to indicate a water filter status.

15. A shelf-integrated water dispenser for use ii-inside a refrigerator appliance, the shelf-integrated water dispenser comprising:

at least one shelf, the at least one shelf being supported by at least one shelf support bracket; and a water dispenser integrated with the at least one shelf support bracket so as to form at least a portion of the at least one shelf support bracket.

16. The shelf-integrated water dispenser of claim 15, wherein the at least one shelf support bracket comprises a hollow inner portion, and the water dispenser includes a water dispenser track which is mounted to a push-push mechanism assembly, with the push-push mechanism assembly and the water dispenser track being mounted in the hollow inner portion of the at least one shelf support bracket.

17. The shelf-integrated water dispenser of claim 16, wherein the push-push mechanism assembly is configured to dispose the water dispenser in a pushed in condition where the water dispenser does not extend beyond a front edge of the at least one shelf, and is configured to dispose the water dispenser in a pushed out condition where the water dispenser is extended out beyond the front edge of the at least one shelf.

18. The shelf-integrated water dispenser of claim 17, wherein the water dispenser comprises an activation button that is exposed in the pushed out condition.

19. The shelf-integrated water dispenser of claim 17, wherein the water dispenser comprises an activation paddle for activation in the pushed in condition.

20. A refrigerator comprising:

a fresh food compartment;

at least one shelf assembly disposed in the fresh food compartment; and a water dispenser integrated within the at least one shelf assembly so as to form at least a portion of the at least one shelf assembly, the water dispenser being accessible from inside the fresh food compartment.

* * * * *